US006274816B1

(12) United States Patent
Kendall, Jr.

(10) Patent No.: US 6,274,816 B1
(45) Date of Patent: Aug. 14, 2001

(54) WELDED CONNECTOR FOR INSULATED CONDUCTORS IN METAL TUBINGS

(76) Inventor: Clarence E. Kendall, Jr., 3827 Wickersham, Houston, TX (US) 77027

( * ) Notice: Subject to any disclaimer, the term of this patent is extended or adjusted under 35 U.S.C. 154(b) by 0 days.

(21) Appl. No.: 09/459,236

(22) Filed: Dec. 10, 1999

(51) Int. Cl.[7] ..... H01R 13/52
(52) U.S. Cl. ..... 174/84 R
(58) Field of Search ..... 174/84 R, 84 S, 174/89, 84 C, 88 C; 439/585, 638

(56) References Cited

U.S. PATENT DOCUMENTS 4,515,991 * 5/1985 Gupta ..... 174/102 R
4,668,038 * 5/1987 Burnett et al. ..... 174/76 X
4,985,598 * 1/1991 Bubica et al. ..... 174/93
5,399,810 * 3/1995 Hayami ..... 174/84 R
5,855,062 1/1999 Kendall, Jr. ..... 254/134.4
5,979,881 11/1999 Kendall, Jr. ..... 29/828
6,069,320 * 5/2000 Rocci et al. ..... 174/84 R

* cited by examiner

*Primary Examiner*—Dean A. Reichard
*Assistant Examiner*—Chau N. Nguyen
(74) *Attorney, Agent, or Firm*—Fulbright & Jaworski

(57) ABSTRACT

A welded connector for sealably and fixedly connecting ends of first and second slicklifles together in which the slicklines each include an electrically insulated conductor enclosed in a metal tubing. The ends of the slicklines are threadably secured to support rings, the electrical connectors are connected and encased in a plastic seal in a housing, and a compression ring at each end is threadably connected to the housing. All of the exposed parts are sealably welded.

4 Claims, 4 Drawing Sheets

END VIEW

WELDED CONNECTOR FOR INSULATED CONDUCTORS IN METAL TUBINGS

FIELD OF THE INVENTION

The present invention is directed to a welded connector for connecting two lengths of insulated electrical conductors which are encased in metal tubings.

BACKGROUND OF THE INVENTION

U.S. Pat. Nos. 5,855,062 and 5,979,881 describe methods and apparatus for manufacturing long lengths of insulated electrical conductors which are enclosed in metal tubings. As used in this description, the term "slickline" refers to a long length of insulated electrical conductor such as a wire or fiber optics, which is enclosed in an equally long length of metal tubing. Such slicklines are useful in various applications, for example, in well bores for providing electrical power and/or making various measurements from various types of instruments. Generally, while slicklines maybe manufactured in various lengths, for example only, 10,000 feet, this may not be sufficient for use in well bores where oil and gas wells are being drilled at depths in excess of 20,000 feet. Therefore, in order for slicklines to be used in environments which are in excess of their manufacturing length, it is necessary to connect two or more slicklines together. This will entail using a connector to connect the first and second slicklines and a connector to connect the second and additional slicklines if such are needed.

A preponderance of the deep wells currently being drilled or planned will be drilled offshore where very high per inch pressures will be encountered. Therefore, any connector used must be able to withstand all downhole pressures and permit no leakage.

One troublesome problem in downhole well logging in high pressure environments is the use of complex thread patterns, gaskets and O-rings which often fail. Another problem is the use of connectors which are not suitable for field installation and still another problem is the use of expensive and complicated types of connectors.

SUMMARY OF THE INVENTION

The present invention is directed to a welded connector for connecting two insulated conductors enclosed in metal tubings together in which the connector is able to withstand high pressures and permit no fluid leakage without the use of flexible seals and O-rings which have a tendency to fail.

Another object of the present invention is the provision of a connector which can serve to repair damaged slicklines by merely cutting away the damaged parts, thread the ends, and install the present conductor which can be done in the field.

Yet a still further object is the provision of a connector which can be easily manufactured at low cost and on disassembly can be discarded at minimal expense.

Yet a further object of the present invention is the provision of a welded connector for sealably and fixedly connecting ends of first and second slicklines together in which the slicklines each include a first electrical insulated conductor enclosed in a first metal tubing and a second electrical insulated conductor enclosed in a second metal tubing, respectively.

The connector includes a first support ring threadably secured to the exterior of the first metal tubing and a second support ring threadably secured to the exterior of the second metal tubing. A housing having first and second ends encloses the ends of the first and second slicklines and the first and second support rings. The first electrical conductor and the second electrical conductor are electrically connected together inside of the housing forming an electrical connection and the electrical connection is encased in a plastic seal.

The connector further includes a first compression ring slidably enclosing the end of the first slickline and threadably connected to the first end of the housing and a second compression ring slidably enclosing the end of the second slickline and threadably connected to the second end of the housing.

The first compression ring is sealably welded to the first slickline and to the first end of the housing and the second compression ring is sealably welded to the second slickline and to the second end of the housing thereby providing a seal and fixably connecting the connector to the first and second slicklines.

Yet a further object of the present invention is the provision of separator means positioned between the first and second support rings such as separator rods for facilitating the assembly of the connector.

Still a further object of the present invention is the provision of a trough supported from the separator means for initially supporting the plastic seal around the electrical connection.

Still a further object of the present invention is wherein the first compression ring abuts the first support ring and the first end of the housing, and the second compression ring abuts the second support ring and the second end of the housing.

Other and further objects, features and advantages will be apparent from the following description of a presently preferred embodiment ofthe invention, given for the purpose of disclosure, and taken in conjunction with the accompanying drawings.

DETAILED DESCRIPTION OF THE PREFERRED EMBODIMENT

Figure 1:
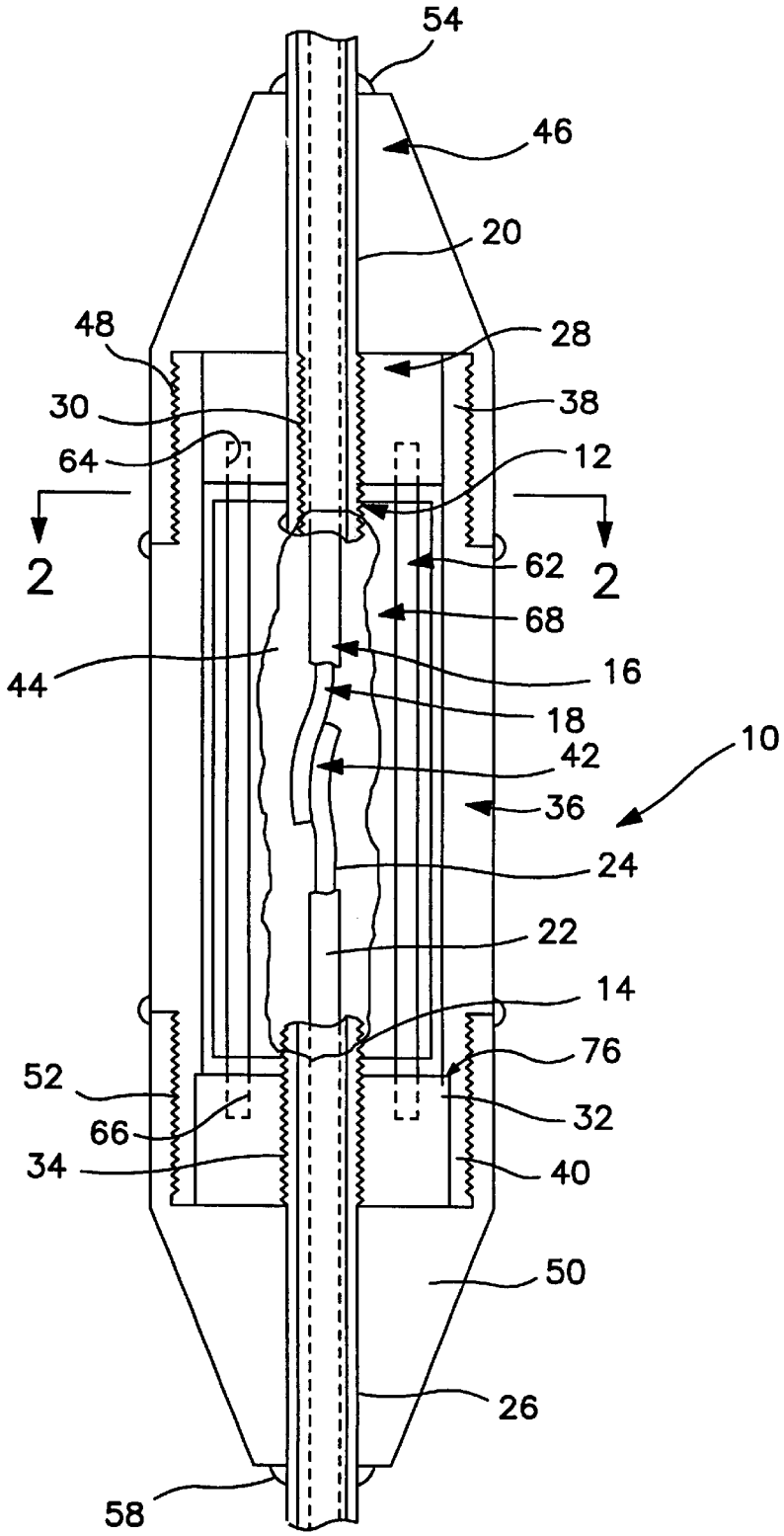
FIG. 1 is an elevational view in cross section of the welded connector of the present invention.
Figure 2:
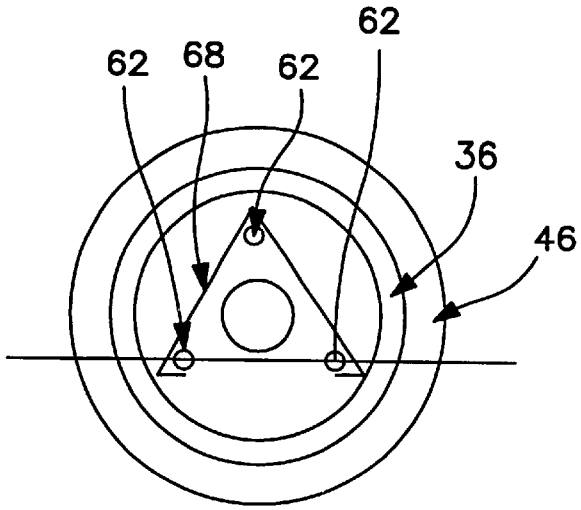
FIG. 2 is a cross-sectional view taken along the line 2—2 of FIG. 1.

Referring now to the drawings, and particularly to FIGS. 1 and 2, the welded connector of the present invention is generally indicated by the reference numeral 10 for suitably and fixably connecting the ends of a first slickline 12 and a second slickline 14 together in which each of the slicklines includes an electrically insulated conductor enclosed in a metal tubing. Thus, the first slickline 12 includes a first electrically insulated conductor 16 having a conductor wire or fiber optics, here shown as having a first conductor wire 18 and is enclosed in a first metal tubing 20. The second slickline 14 includes a second electrical insulated conductor 22 having an electrical conductor such as a wire or fiber optics, here shown as second conductor, and wire 24 enclosed in a second metal tubing 26.

A first metal support ring 28 is threadably secured to the exterior of the first metal tubing 20 by coacting threads 30. A second metal support ring 32 is threadably secured to the exterior of the second metal tubing 26 by coacting threads 34.

A housing 36 having first and second ends 38 and 40, respectively, enclose the ends of the first slickline 12 and the second slickline 14 and the first 28 support ring and the second 32 support ring, respectively. The first electrical conductor wire 18 and the second conductor wire 24 are electrically connected by any suitable means such as by soldering inside of the housing 36 forming an electrical connection 42. The electrical connection 42 is encased in a suitable plastic seal 44 such as epoxy.

A first compression ring 46 slidably encloses the end of the first slickline 12 and is threadably connected to the first end 38 of the housing 36 such as by coacting threads 48. A second compression ring 50 slidably encloses the end of the second slickline 14 and is threadably connected to the second end 40 of the housing 36 such as by coacting threads 52.

Figure 5:
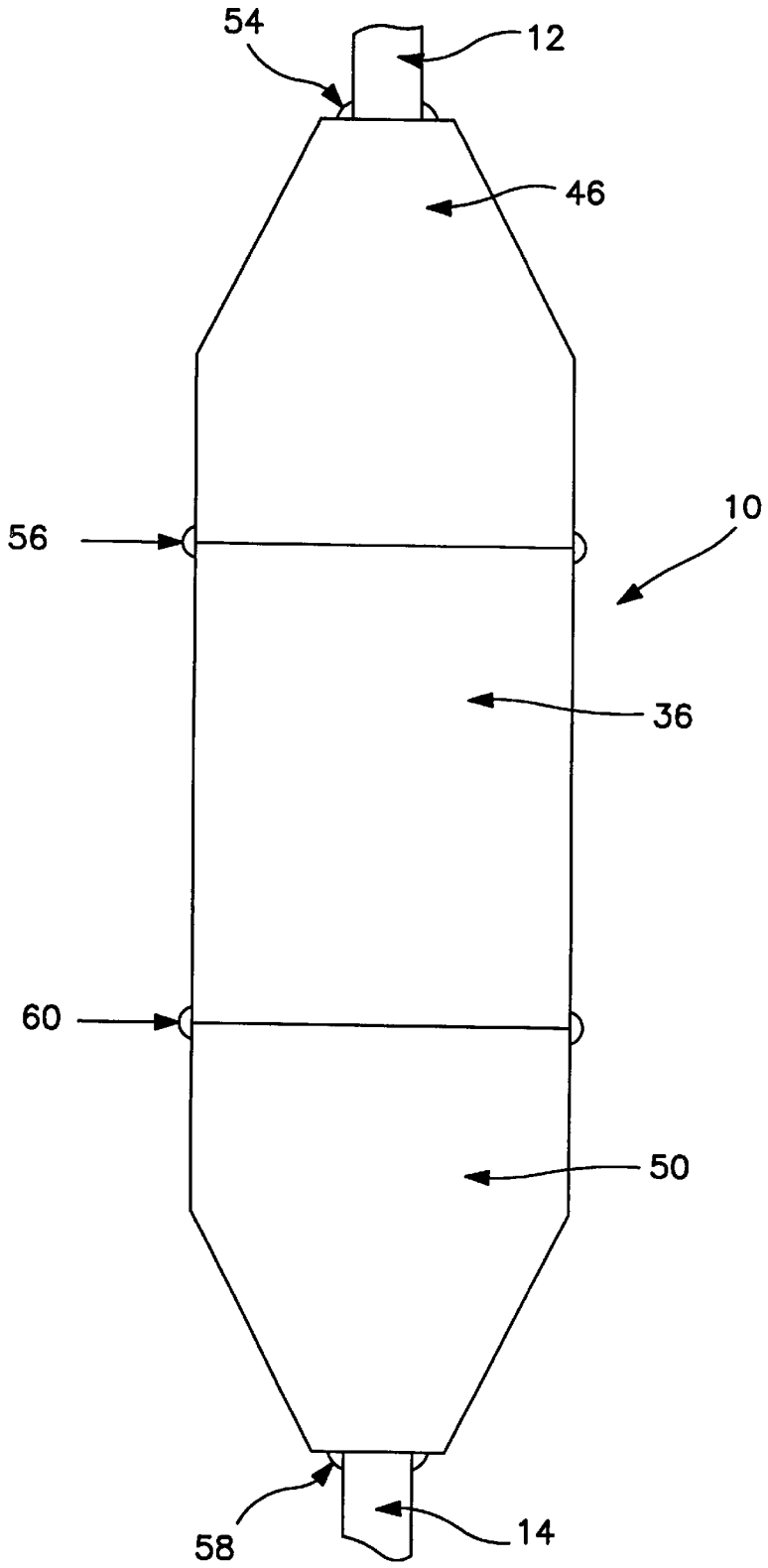
FIG. 5 is an elevational view of the assembled connector of the present invention.

After assembly, as best seen in FIG. 5, the first compression ring 46 is sealably welded to the first slickline 12 and to the first end of the housing 36 forming welds 54 and 56, respectively. The second compression ring 50 is sealably welded to the second slickline 14 and to the second end of the housing 36 by welds 58 and 60, respectively. The compression rings 46 and 50, the support rings 28 and 32, and the housing 36 may be of any suitable weldable material such as stainless steel. The welds 54, 56, 58 and 60 may be suitably welded by any satisfactory means such as an orbital welding machine which is portable and field usable. Thus, the completed welded connector 10 is sealably and fixably connected together which assure an absolute seal regardless of downhole pressures. When the slicklines 12 and 14 are welded to the connector 12, the connector and assembly become a single integrated unit. Therefore, disassembly can only be accomplished by cutting each end of the connector 10 from the slicklines 12 and 14 to which it is welded. The connector 10 is then discarded as it is comprised of simple and inexpensive parts.

While the plastic seal or epoxy may be applied by any suitable means, it is desirable that sufficient epoxy 44 be provided to cover the protruding ends of both slicklines 12 and 14 and the entire electrical connection 42. When the epoxy 44 hardens, it will have the effect of blocking the annulus between the insulated conductors 16 and 22 and the inside of each respective slickline 12 and 14. This has the advantage that first in the event that the metal tubing of a slickline is damaged so that water enters into annulus, it will be unable to pass into the electrical connection 42 and possibly cause a short circuit. Secondly, the insulated conductors 16 and 22 may have a tendency to stretch, but cannot stretch because of the epoxy. Finally, the epoxy insures the insulation of the connection 42. Blocking passage into the connection 42 is important when the slickline contains fiber optics, instead of conductor wire, because fiber optics have a tendency to stretch in vertical use.

One way of applying the epoxy 44 is by providing separator means 62 such as a plurality of metal rods, here shown as three (FIGS. 1 and 2), having ends which fit into holes drilled into the faces of the support rings. Thus, holes 64 and 66 are provided in the faces of the support rings 28 and 32, respectively, and are used to hold a trough 68 which may be any suitable material which is supported and hangs from two of the rods 62 and having a length which is approximately the distance between the faces of the first support ring 28 and the second support ring 32 for supporting and holding the epoxy 44 until it hardens.

Figure 4:
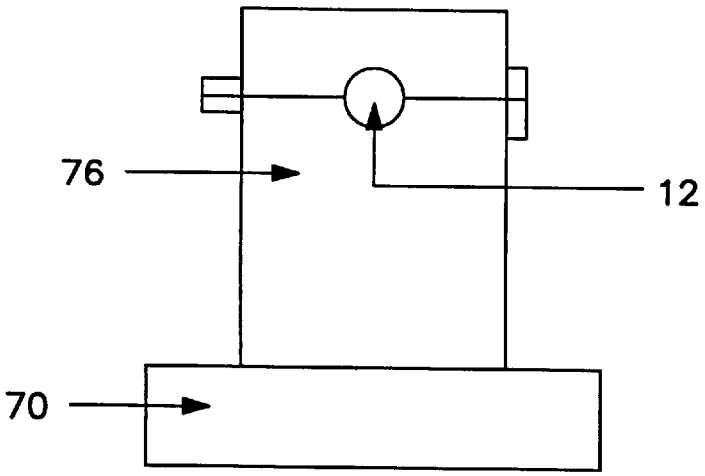
FIG. 4 is an end view of the cradle taken along line 4—4 of FIG. 3.
Figure 3:
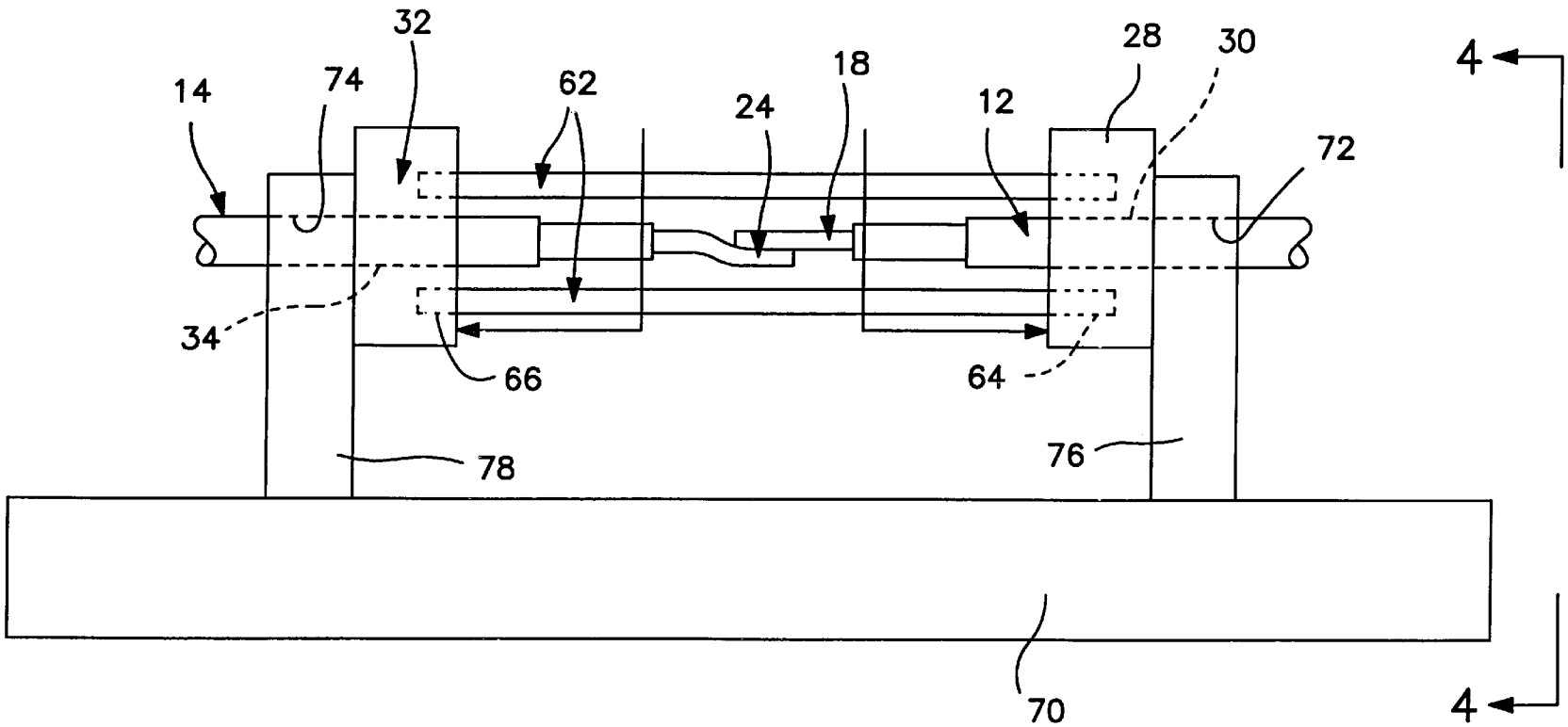
FIG. 3 is an elevational view of a cradle shown in position partially assembling the connector of the present invention.

While various methods of assembly of the connector 10 may be used, a suitable jig or cradle 70, as best seen in FIGS. 3 and 4, may be utilized. In assembling the connector 10, the first compression ring 46 and housing 32 is slid onto the first slickline 12 out of the way for later assembly. The first support ring 28 is screwed up on the end of the first slickline 12 by the use of coacting threads 30 to the full extent of the threads. Next, the second compression ring 50 is slid onto the second slickline 14. The second support ring 32 is screwed onto the end of the second slickline 14 to the extent of the threads 34.

The ends of the slicklines 12 and 14 are then inserted into the openings 72 and 74 in the cradle 70 for support. The support rings 28 and 32 are threadably adjusted so that the separator rods 62 may be placed in the holes 64 and 66 in each of the support rings 28 and 32, respectively. For example only, assuming that the cradle supports 76 and 78 are six inches apart and the support rings 28 and 32 are each ¾ of an inch wide, the distance between the support rings 28 and 32 will be 4½ inches apart. The support rings 28 and 32 will be kept apart by the separator rods 62 so that when the separator rods 62 arc inserted into and between the support rings 28 and 32, the assembly will fit between the holders 76 and 78 on the cradle 70. The separator rods 62 provide means for facilitating the assembly of the connector 10. Before the assembly is placed in position, the tops of the holders 76 and 78 are unlatched about their hinges to open the holes 72 and 74 and the slickline assembly is put into the cradle 70, and the tops are closed and latched. When so inserted, neither support ring 28 and 32 will be able to move out of position.

The next step is to suitably splice the conductor wires 18 and 24 by any suitable means, such as a connector or by soldering. Next the epoxy trough 68 (FIGS. 1 and 2) is supported from two of the rods 62 and the epoxy is installed therein between the faces of the support rings 28 and 32 sufficient to cover the ends of each slickline 12 and 14, and the electrical connection 42.

After the epoxy has hardened, the partial assembly may be removed from the cradle 70 to slide the housing 36 towards the support ring 32 until a shoulder 76 rests on the support ring 32. The compression ring 50 is then moved into engagement with the housing 32 and the second compression ring 50 is screwed onto the housing 36 by coacting threads 52.

The compression ring 46 is then slid along the first slickline 12 into engagement with the housing 36 and compression ring 46 is screwed onto the second end of the housing 36 by coacting threads 48. The first compression ring 46 and second compression ring 50 are tightened and the circumferential welds 54, 56, 58 and 60 (FIG. 5) are welded at each joint of the connector 12.

The connector 10 of the present invention will sealably and fixably unitize two or more slicklines into one continuous integrated slickline. For example, two 10,000 feet reels of slickline may be taken to a wellhead and the second slickline 14 lowered into a well bore with the upper end held in slips while the first slickline 12 is affixed to the second slickline 14 by means of the connector 10. In addition to its other advantages, the connector 10 eliminates handling reels containing more than a fixed length, such as 10,000 feet. In addition to ease of handling, if a portion of a slickline is damaged, the damaged portion may be cut away and the resulting end permanently joined together by the connector 10.

The connector 10 consists of a minimum of parts, some of which are identical and thus interchangeable and none ofthe parts are difficult, complicated or expensive to manufacture, so the cost is minimum. In addition, when the ends of the slicklines 12 and 14, which are attached to a connector 10, are cut free they may then be rethreaded. After rethreading, the slicklines 12 and 14 may then be unitized with another connector 10.

In addition, the connector 10 can serve to repair damaged slicklines because all that is necessary is to cut away the damaged parts, thread the ends, and install a connector. This can be done in the field at the wellhead.

The present invention, therefore, is well adapted to carry out the objects and attain the ends and advantages mentioned as well as others inherent therein. While a presently preferred embodiment of the invention has been given for the purpose of disclosure, numerous changes in the details of construction, arrangement of parts will be readily apparent to those skilled in the art, and which are encompassed within the spirit of the invention and the scope of the appended claims.

What is claimed is:

1. A welded connector for sealably and fixably connecting ends of first and second slicklines together in which the slicklines include a first electrical insulated conductor enclosed in a first metal tubing and a second electrical insulated conductor enclosed in a second metal tubing, respectively, comprising, a first metal support ring threadably secured to the exterior of the first metal tubing by coacting threads, a second metal support ring threadably secured to the exterior of the second metal tubing by coacting threads, a housing having first and second ends enclosing the ends of the first and second slicklines and the first and second support rings, said first electrical conductor and said second electrical conductor electrically connected together inside of the housing forming an electrical connection, said electrical connection being encased in a plastic seal, a first compression ring slidably enclosing the end of the first slickline and threadably connected to the first end of the housing, a second compression ring slidably enclosing the end of the second slickline and threadably connected to the second end of the housing, said first compression ring sealably welded to the first slickline and to the first end of the housing, and said second compression ring sealably welded to the second slickline and to the second end of the housing.

2. The connector of claim 1 including, separator means positioned between the first and second support rings.

3. The connector of claim 2 includes a trough supported from the separator means for initially supporting the plastic seal.

4. The connector of claim 1 wherein the first compression ring abuts the first support ring and the first end of the housing, and the second compression ring abuts the second support ring and the second end of the housing.

* * * * *